US006594845B1

(12) United States Patent
Hyatt et al.

(10) Patent No.: US 6,594,845 B1
(45) Date of Patent: Jul. 22, 2003

(54) BRUSHING TOOL AND METHOD OF USING THE SAME

(75) Inventors: Gregory Aaron Hyatt, West Chester, OH (US); Michael Joseph Sess, Cincinnati, OH (US); Steven G. Hall, Cincinnati, OH (US); Matthew R. Zimmerer, Royal Oak, MI (US)

(73) Assignee: Makino, Inc., Mason, OH (US)

( * ) Notice: Subject to any disclaimer, the term of this patent is extended or adjusted under 35 U.S.C. 154(b) by 37 days.

(21) Appl. No.: 09/827,309

(22) Filed: Apr. 5, 2001

Related U.S. Application Data

(60) Provisional application No. 60/194,831, filed on Apr. 5, 2000.

(51) Int. Cl.[7] ..... B08B 9/047

(52) U.S. Cl. ..... 15/88; 15/21.1; 15/104.05; 15/104.095

(58) Field of Search ..... 15/21.1, 88, 88.3, 15/88.4, 104.09, 104.05, 104.095, 104.03

(56) References Cited

U.S. PATENT DOCUMENTS

| | | | | |
|---|---|---|---|---|
| 1,082,922 | A | | 12/1913 | Bemis |
| 1,100,113 | A | | 6/1914 | Bemis |
| 1,228,773 | A | | 6/1917 | Hartman |
| 1,240,507 | A | | 9/1917 | Spiekerman |
| 1,415,950 | A | | 5/1922 | Poole |
| 1,917,383 | A | | 7/1933 | McCarthy |
| 2,204,755 | A | | 6/1940 | Gonsor |
| 2,275,939 | A | | 3/1942 | Baker |
| 2,327,986 | A | * | 8/1943 | Bach |
| 2,402,223 | A | | 6/1946 | Wright |
| 2,438,673 | A | | 3/1948 | McMahan |
| 2,909,796 | A | | 10/1959 | Ver Nooy |
| 2,922,174 | A | | 1/1960 | Mathews |
| 3,389,621 | A | | 6/1968 | Wear |
| 3,545,026 | A | | 12/1970 | Beer |
| 4,224,846 | A | | 9/1980 | Eysel et al. |
| 4,289,431 | A | | 9/1981 | Berstein |
| 5,800,252 | A | | 9/1998 | Hyatt |
| 5,819,353 | A | | 10/1998 | Armell et al. |
| 5,865,573 | A | | 2/1999 | Kress |
| 6,343,648 | B1 | * | 2/2002 | Carmichael |

FOREIGN PATENT DOCUMENTS

| | | |
|---|---|---|
| GB | 2013539 | 8/1979 |

* cited by examiner

*Primary Examiner*—Randall E. Chin
(74) *Attorney, Agent, or Firm*—Dinsmore & Shohl LLP

(57) ABSTRACT

Tools for brushing an inner surface of a hole are provided including a rotatable shaft, an inlet in fluid communication with a source of pressurized fluid, at least one outlet positioned so as to wet an inner surface of a hole, and a flow path extending between the inlet and the outlet. The tool further includes at least one brush being radially moveable relative to the shaft to an extended position and a retracted position.

24 Claims, 10 Drawing Sheets

BRUSHING TOOL AND METHOD OF USING THE SAME

CROSS-REFERENCES TO RELATED APPLICATIONS

This application claims the benefit of U.S. Provisional Application No. 60/194,831 filed Apr. 5, 2000 which is herein incorporated by reference.

TECHNICAL FIELD OF THE INVENTION

The present invention relates generally to tools and methods for brushing, and will be specifically disclosed as a machining tool and method for brushing the inner surface of a bore.

BACKGROUND OF THE INVENTION

In a variety of different applications and industries, it is desirable to brush the surfaces in and around machined holes. For instance, machining parts such as metal stock of steel or some other alloy, are often designed with a hole or bore. Typically, the rough dimensions of the bore are initially cast and/or machined, and then one or more subsequent machining steps are required to achieve the final bore dimensions. In some applications, (e.g. boring engine cylinders), a finishing honing operation is also performed on the inner surface of the bore. After a bore is machined and honed, it is known to brush the inner surface to remove residual metal shavings or fines that may remain after the machining or honing operations. If this residual material is not removed, application of the part may cause damage to the part, or corresponding apparatus. For instance, failure to remove residual metal shavings from the bore of an engine cylinder may contaminate the oil supply of the engine in use. As a result, the lubricating oil may be reduced to an abrasive slurry that can be detrimental to engine/pump life.

As with other machining steps and processes, it is desirable to minimize cycle time while maximizing tool life. In brushing operations, cycle time can be minimized by applying increased force between the brush and the material being brushed (e.g., between the brush and the interior bore surface). However, if too much force is applied by the brush to the material, the brush may undesirably crack or even fail. Furthermore, conventional brushes typically wear during use, thereby requiring mechanical and/or manual adjustment of the brushes so that the desired force can be maintained. Such adjustments can be time consuming, since known conventional brush adjustment cannot be accomplished while the tool is simultaneously performing a brushing operation. Known brush adjusting techniques are also inaccurate whereby the desired force being applied to the material is not achieved. Moreover, adjustment during non-use will not compensate for wear or the varying force being applied to the material that can occur during a tool cycle.

In almost all machine tool operations, including brushing, the friction between the tool and workpiece generates a tremendous amount of heat energy that can result in temperatures reaching 2000° F. (1100° C.) and above. If left uncontrolled, such excessive temperatures may severely damage (e.g., cracking or fracturing) the tool, thereby reducing its tool life, making machine tool operations more dangerous and expensive, and/or reducing the quality and precision of the workmanship. In addition, heat generated friction can discolor the workpieces, and can damage or remove temper or heat treatments. It is commonly known in the industry that coolant can be introduced to the machining area, such as by spraying, to reduce friction between the tool and workpiece by maintaining a thin film of coolant fluid between the tool and the workpiece, and to help remove heat energy generated in machine tool operations.

Although coolant fluid can be supplied to the brushing area, it is often difficult to ensure that such fluid actually makes its way to the interstices between the tool and all of the workpiece surfaces being machined. Additionally, fluid tends to evaporate quickly due to the high temperatures involved in brushing operations. Thus, larger volumes of coolant fluid must generally be continuously supplied to the brushing area for effective brushing tool operation. The desire to maintain coolant fluid between the brushing tool and inner surface of the bore becomes even more problematic in operations where coolant fluid cannot be introduced in close proximity to the brushing areas while the brushing tool is being used to brush the bore surface.

During operation, the work engaging surface (e.g., brushes) of the tool can also become loaded with particles or recently cut chips from the surface of the workpiece, which in turn, reduces the accuracy and effectiveness of the tool through deteriorating brushing ability, and/or clogging of conventional coolant fluid supply openings. It is obviously preferred to reduce the undesired loading of particles, and that any loaded particles be promptly removed from the brushing tool. Conventional nozzle arrangements are often provided with an independent external cleaning jet for injecting coolant fluid. Typically, the cleaning jet is designed to direct a high velocity stream of fluid toward the work engaging surface and the work surfaces of the workpiece to wash away particles, to remove residual particles from the work surface, and to cool the brushing tool and the workpiece. However, as mentioned previously, it is often difficult to ensure that the fluid sprayed in this way actually reaches the most critical areas of the tool/workpiece interface.

Other attempts to deliver coolant fluid to the brushing area have included air or other pneumatic carriers. As with externally applied liquid coolants, pneumatic carriers typically result in turbulence that can hinder the brushing operations, and may not permit fluid from infiltrating into the actual brushing area. Previous attempts to address these cooling and cleaning requirements often tend to reduce the accuracy and utility of the tool.

As can be seen, conventional brushing tools have a number of shortcomings that can greatly reduce the tool's life, its effectiveness, and the ability to use it with an automatic tool changing system. The current structures and assemblies of brushing tools do not provide a generally constant force between the brush and the workpiece being brushed which can result in shaving and chips not being removed from the machined piece.

SUMMARY OF THE INVENTION

Accordingly, it is an object of the present invention to address and obviate problems and shortcomings of conventional brushing tools.

It is a further object of the present invention to provide an improved brushing tool that has an increased tool life.

It is a further object of the present invention to provide an improved performance brushing tool that can be selectively adjusted during machining operations.

It is yet another object of the present invention to provide an improved brushing tool that can be easily removed from a tool mandrel.

Still another object of the present invention is to provide our improved brushing tool that can be used with a quick change or automatic changeable tool system having a source of pressurized fluid.

A further object of the present invention is to provide an improved brushing tool which can regulate itself to adjust for wear and tear on the brushes.

Another object of the present invention is to provide a tool and method for brushing surfaces, such as the inner surfaces of a bore in a workpiece.

To achieve the foregoing and other objects in accordance with the present invention, tools for brushing an inner surface of a hole are provided including a rotatable shaft, an inlet in fluid communication with a source of pressurized fluid, at least one outlet positioned so as to wet an inner surface of a hole, and a flow path extending between the inlet and the outlet. The tool further includes at least one brush being radially moveable relative to the shaft to an extended position and a retracted position, wherein the brush is adapted to move to the extended position when the shaft is rotating and a brush retractor connected to the brush.

To achieve further objects in accordance with the present invention, tools for brushing an inner surface of a hole are provided with a mandrel capable of being rotated about an axis. The tool further includes a fluid channel in the mandrel having an inlet for receiving pressurized fluid and at least one outlet for wetting an inner surface of a hole and a brush assembly attached to the mandrel comprising at least one brush. The brush assembly being radially moveable relative to the mandrel to an extended position and a retracted position. The brush assembly is also adapted to move to the extended position at least in part due to an outward radial force generated by the rotation of the mandrel when the mandrel is rotating.

To achieve still further objects in accordance with the present invention, tools are provided for brushing an inner surface of a hole. The tool includes a mandrel capable of being rotated about an axis and a fluid channel in the mandrel having an inlet for receiving pressurized fluid and an outlet for wetting an inner surface of a hole. A brush assembly is also included with at least one brush attached to a brush mount and one or more supports attached at one end to the brush mount and slidably attached to the mandrel at the other end. The brush assembly is radially moveable relative to the mandrel to an extended position and a retracted position. In addition, the brush assembly is adapted to move to the extended position at least in part due to an outward radial force generated by the rotation of the mandrel when the mandrel is rotating. A brush retractor is capable of inducing a radially inward load on the brush assembly thereby biasing the brush assembly toward the retracted position. The mandrel may be rotated such that the inward load is less than the outward force thereby orienting the brush assembly in the extended position.

Still other advantages and objects of the present invention will become apparent to those skilled in the art from the following description wherein there are shown and described alternative exemplary embodiments of this invention. As will be realized, the invention is capable of other different, obvious aspects, objects and embodiments, all without departing from the scope of the invention. Accordingly, the drawings, objects and descriptions should be regarded as illustrative and exemplary in nature only, and not as restrictive.

BRIEF DESCRIPTION OF THE DRAWINGS

While the specification concludes the claims particularly point out and distinctly claiming the present invention, it is believed that the same will be better understood from the following description taken in conjunction with the accompanying drawings.

The accompanying drawings, incorporated in and forming part of the specification, illustrate several aspects of the present invention and, together with their descriptions, serve to explain the principles of the invention. In the drawings.

DETAILED DESCRIPTION OF THE PREFERRED EMBODIMENTS

Figure 1:
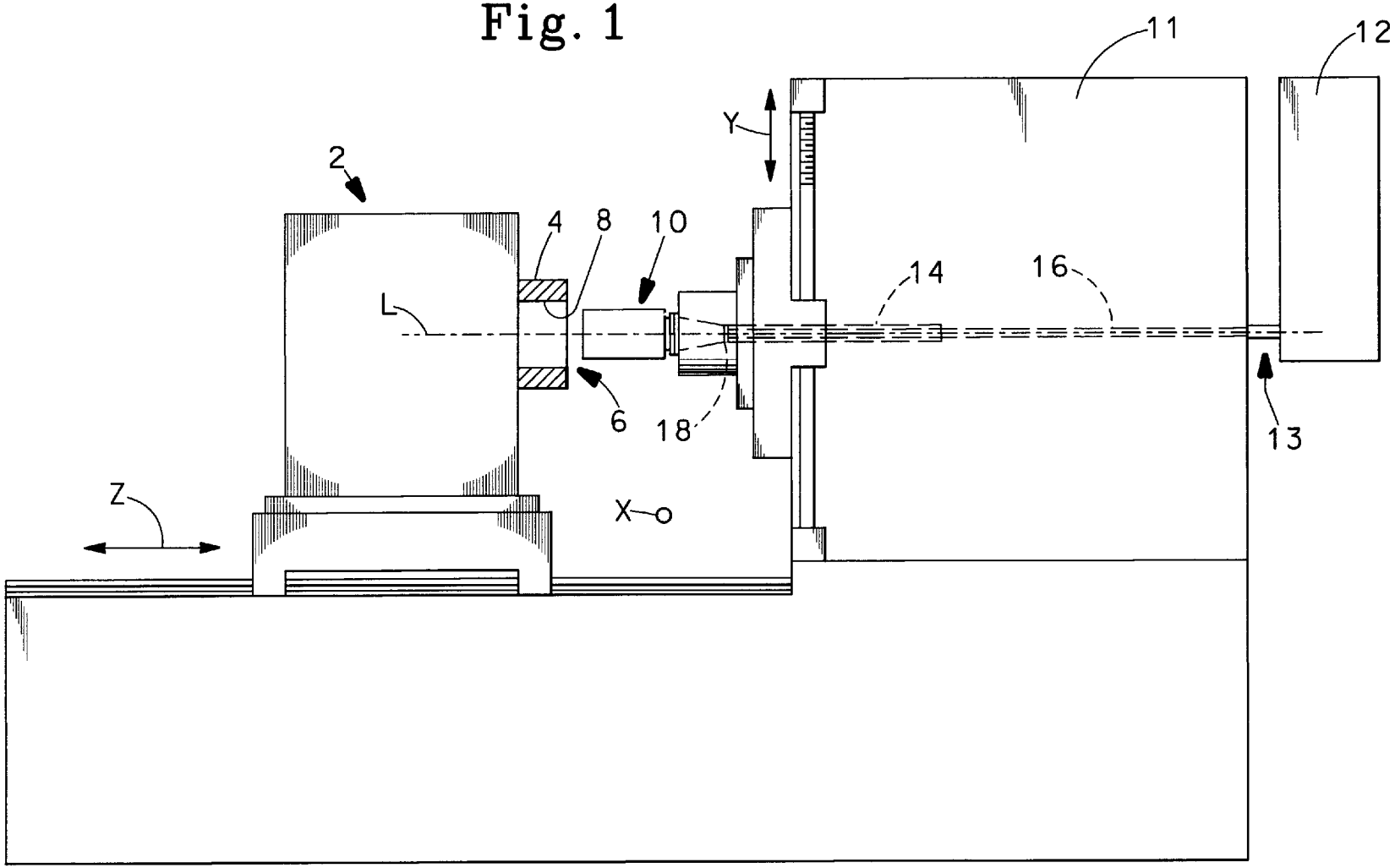
FIG. 1 is a schematic elevational view illustrating a work area for a machine tool.

Reference will now be made to the present preferred embodiment of the invention, an example of which is illustrated in the accompanying drawings, wherein like numerals indicate the same element throughout the views. FIG. 1 illustrates a working area which typically comprises a machining station 11 and a work head 2 having a workpiece 4 attached thereto using fixtures and techniques known in the industry. The workpiece 4 is illustrated as a single exemplary structure having a bore 6 or similar hollow hole or interior portion which requires brushing or finishing. In operation, the tool 10 and workpiece 4 are generally rotated or moved relative to each other as tool 10 is brought into contact with the workpiece 4 (see arrow "Z") in order to enable machining operations, such as brushing. It will also be understood that in certain embodiments adjustment may also be made along horizontal axis "X" and/or vertical axis "Y".

In the present embodiment, the machining station 11 includes a machine spindle 14 which can be rotated at varying speeds by a power source (not shown), and which can quickly and easily receive and secure one of a plurality of tools for various operations (i.e., rotating, vibrating or oscillating). A machining station 11 typically has a synchronized system, such as an automatic tool changer (not shown), for quickly and easily interchanging and utilizing multiple matching tools at one machining station or center 11, thereby allowing machining station 11 to provide greater utility or range of operations, (i.e., they are not dedicated to a single operation or use of a single type of tool).

In the present embodiment, the tool 10 is attached in a generally cantilevered fashion to the machine spindle 14 using an engaging assembly (i.e., clamping or otherwise securing) drawbar, a collet, a mandrel device, or other device known in the industry. Fluid may be provided to the tool 10 adjacent the spindle/tool interface 18 while the tool 10 is in use. A preferred engaging assembly allows for the quick interchange of tools and for the provision of fluid communication between the spindle passage 16 and the tool 10 at tool/spindle interface 18 without the need for separately hooking up hydraulic lines or other fluid connections. For instance, the engaging assembly disclosed in U.S. Pat. No. 5,800,252, the disclosure of which is hereby incorporated herein by reference, can readily be adapted to the tool 10. As will be understood, the tool 10 could also be utilized in conventional applications and dedicated operations as well.

The work area also includes a fluid supply system 13 that generally provides a source of pressurized fluid 12 to be routed through the spindle 14 (via spindle passage 16) and to the tool 10. The fluid supply system 13, which in this embodiment is often referred to as a through-spindle coolant or fluid system, also generally includes a compressor or other system (not shown) for pumping fluid at the desired pressure and/or flow rate. The spindle passage 16 has a distal end that can automatically seal the tool 10 at the tool/spindle interface 18. This seal might be provided in a variety of structural arrangements, including O-ring, seals and the like, and its exact structure may vary among particular applications. Fluid communication is thereby automatically and immediately established and maintained between the spindle passageway 16 and the tool 10 when the tool 10 is engaged and held in place by any one of various engaging assemblies and techniques known in the industry, as discussed previously. It should be noted that when the tool 10 is not engaged, mechanisms known in the industry (e.g., shut off valves or the like) can be used to terminate the flow of coolant fluid adjacent the end of the spindle passage 16.

In use, fluid can be directed under pressure from a fluid source 12 (e.g., from about 200 psi ($1.38\times10^6$ n/m$^2$) to about 250 psi ($1.72\times10^6$ n/m$^2$) and extending upwards to pressures in excess of about 1000 psi ($1.38\times10^6$ n/m$^2$). Liquid fluids, such as any type of coolant/cutting fluids, can be used with the present invention. For example, water-based coolants from about 5% to about 10% emulsified oils (i.e., lower oil content coolants) can be used. If fluid pressures in the fluid source 12 or spindle passage 16 reach about 250 psi ($1.72\times10^6$ n/m$^2$) or above, emulsified oils can become unstable, and therefore, are not preferred. At high pressure, pure coolant fluid oils may be utilized as the fluids, as it is known in the industry that pure coolant fluid oils are also often preferred for providing a better finish on a workpiece.

Figure 2:
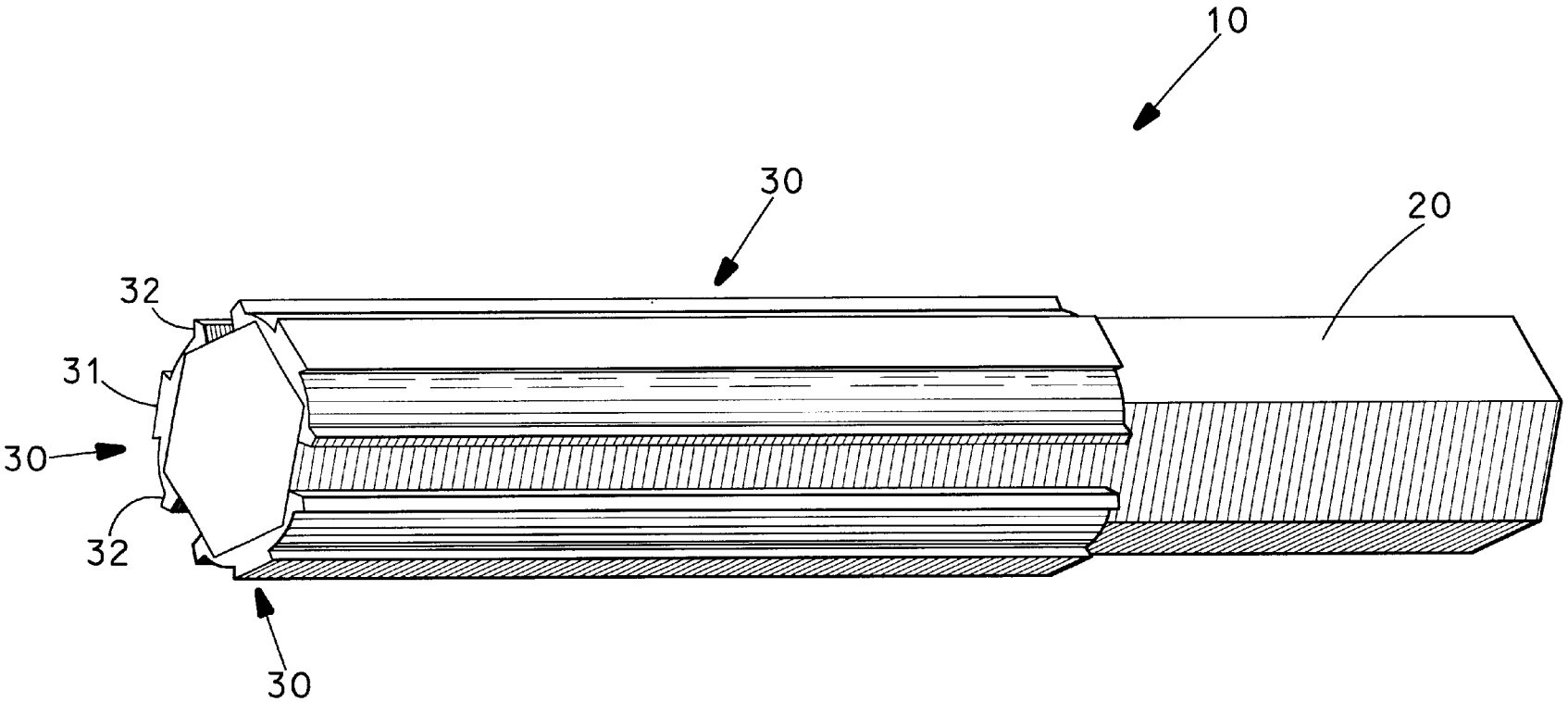
FIG. 2 depicts a perspective view of one embodiment of a brush tool.

By way of illustration, FIG. 2 depicts one embodiment of a tool 10. The tool 10 includes a mandrel 20, which in this embodiment is exemplified as a generally longitudinally extending shaft that is rotatable about its longitudinal axis. It should be noted that the cross-sectional shape of the mandrel 20 can take other various forms and shapes, such as hexagonal (see, e.g., FIG. 2), triangular, cylindrical (See, e.g., FIGS. 4A, 4B, 9A and 9B), pentagonal, and the like. For instance, a tool with cylindrical shape may be relatively less expensive to manufacture. The actual dimensions of the tool 10 may vary depending upon the particular application. The mandrel 20, for instance, can be of any desired length. For one particular example, the mandrel 20 can be sufficiently long to receive brush assemblies 30.

A variety of standard available material in the industry can be used to form mandrel 20 so that it is sufficiently rigid and maintains structural integrity in the desired form during the brushing operation at rotational speeds of from about 200 rpm to about 20,000 rpm, and so that increased fluid pressure does not adversely deform the mandrel 20. Illustrative examples of materials that might be used include aluminum, steel or the like. An aluminum alloy may be used in applications requiring a relatively lightweight tool. A lightweight tool may be preferred when tool 10 is interchanged in machine spindle 14 using an automatic tool changing system.

Figure 3A:
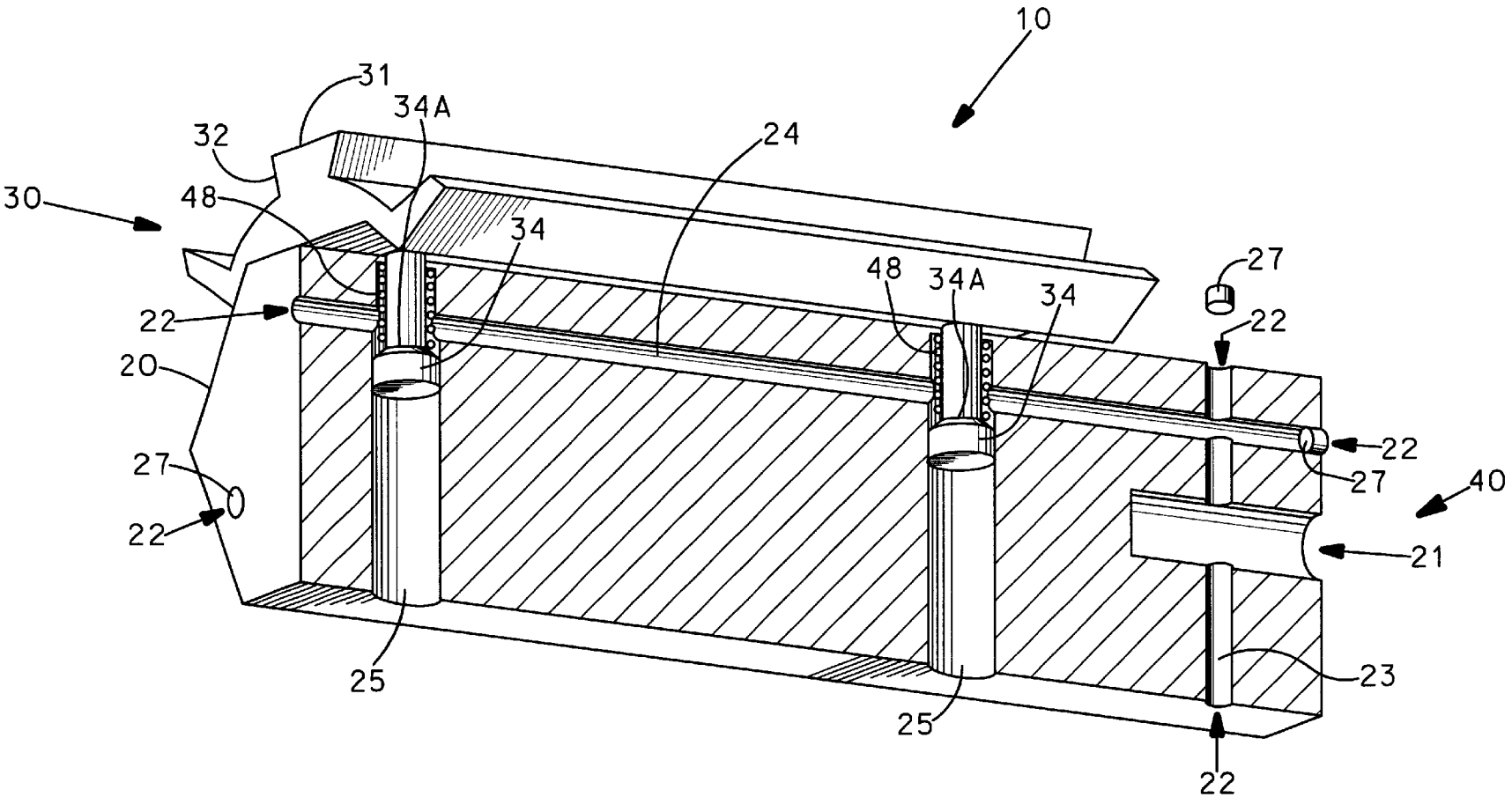
FIG. 3A depicts a cross-sectional oblique view of the brush tool in a retracted position.
Figure 3B:
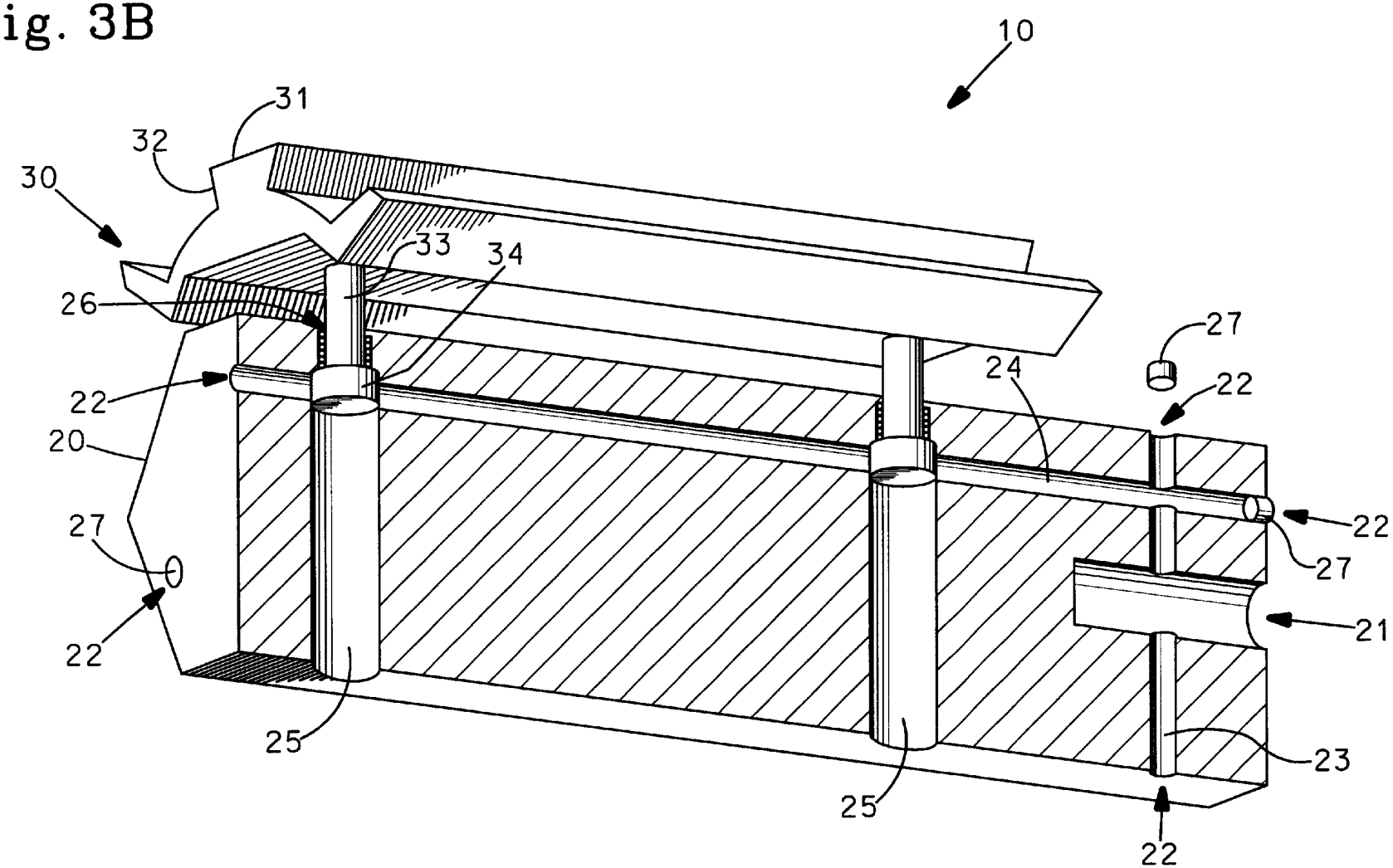
FIG. 3B depicts a cross-sectional oblique view of the brush tool of FIG. 3A in an extended position.

Turning now to FIGS. 3A and 3B, a supply tube or flow path 40 may be formed within the body of tool mandrel 20. The supply tube or flow path 40 may be part of the fluid distribution system extending along the longitudinal length of tool 10 in a predetermined arrangement. Both the tool 10 and the flow path 40 may be oriented so that they share the same center longitudinal axis of rotation. As will be better understood from the description herein, this coaxial orientation of the tool 10 and the flow path 40 may be provided so that the interchanging of tools made in accordance herewith (i.e., securing the tool 10 in place and establishing fluid communication between the spindle passage 16 and the supply tube or flow path) can be accomplished quickly and automatically upon attachment of tool 10, and to preserve balance in the tool 10 so that eccentricities, which otherwise could cause vibration during use, are held to a minimum. In this regard, off-centered routing of one or more flow paths 40 within the tool 10 could be employed. In such cases, these flow paths may be symmetrically arranged relative to the tool mandrel 20 to preserve balance during high speed tool rotation.

Forming the fluid distribution system, including the flow path 40, in the tool mandrel 20 and having fluid routed therethrough also provides an effective heat sink to dissipate thermal energy generated during machining operations, further minimizing undue thermal expansion. If the tool mandrel 20 were to undergo significant or uncontrolled thermal expansion, and particularly in a radial direction, the outer diameter of the tool mandrel 20 would increase, and could adversely affect brushing operations.

The mandrel 20 and its flow path 40 also includes a plurality of outlets 22 which are in fluid communication with the fluid source 12. Pressurized fluid can exit the tool 10 through the outlets 22, holes 26 and/or cylinder 25 to wet the inner surface 8 and/or the tool 10. Accordingly, the pressurized fluid cools the workpiece 4 as well as the tool 10, and also facilitates the removal of metal shavings or fines in the bore 6. The fluid forcefully discharges from the outlets 22 may further provide substantial cooling between the inner surface 8 and the brush surfaces. In one embodiment, the fluid velocity exiting each outlet 22 reaches approximately 47 miles per hour.

A flow path 40 can extend between the inlet 21, which is in fluid communication with the fluid source 12, and the outlets 22 in a predetermined arrangement. In the embodiment of FIGS. 3A and 3B, the flow path 40 is contained within the mandrel 20 and comprises several radial channels 23 and axial channels 24, thereby establishing a fluid distribution system within the mandrel 20. Pressurized fluid can enter the mandrel 20 and its flow path 40 through the inlet 21, is distributed radially via the radial channels 23, and distributed axially via the axial channels 24. Alternatively, as exemplified in FIGS. 3C and 3D, flow path 40 may comprise a central fluid passageway 42. The fluid can exit the mandrel 20 via the outlets 22, through holes 26 and/or cylinder 25. It is contemplated that one or more outlets 22 can be plugged (e.g., with plugs 27) to restrict and/or control, meter or regulate fluid flow out of the mandrel 20 therethrough. Such plugs might take the form of a valve, orifice, or a stop valve or other restriction device. Moreover, all fluid outlets in each of the exemplary embodiments described throughout the specification may include such plugs.

As exemplified in FIG. 2, the tool 10 can include three brush assemblies 30, however, any number of brush assemblies 30 could be used with the present invention. Each brush assembly 30 may include a brush mount 31 having at least one or more mounting grooves 32. While not shown in these particular figures, brushes appropriate for the desired brushing application (See e.g., 62 in FIGS. 7 and 8) can be inserted into the grooves 32. The brushes may include an abrasive impregnated polymer, such as a nylon brush with CBN. As shown here, the brush assemblies 30 are generally axially aligned with one another, however, the brush assemblies 30 could alternatively be staggered along the longitudinal axis of tool mandrel 20. It will also be understood that an inner surface of the brush mount 31 can have a shape corresponding to the outer surface of the mandrel 20. For instance, as illustrated in FIG. 2, the inner surface of the brush mount 31 can have a partial hexagonal cross-sectional shape corresponding to the hexagonal cross-sectional shape of the mandrel 20. In another example, as illustrated in FIGS. 9A and 9B, the inner surface of the brush mount 31 can have an arcuate cross-sectional shape corresponding to the circular cross-sectional shape of the mandrel 20.

In use, the tool 10 can be inserted into the bore 6 and rotated relative to the workpiece 4. The brush assemblies 30 are radially moveable relative to the mandrel 20 to exhibit an extended position where the brushes can engage the workpiece 4, such as the inner surface 8 of the bore 6 (see, e.g., FIG. 3B), and a retracted position where the brushes may not engage the inner surface 8 (see, e.g., FIG. 3A). Accordingly when the tool 10 is inserted in the bore 6 and the tool 10 is rotating relative to the workpiece 4, the brush assemblies 30 are generally in the extended position (e.g., see FIG. 3B) and the inner surface 8 can then be brushed.

The brush assembly 30 can include at least one radially extending support 33 connecting the brush assembly 30 to the mandrel 20. For example, as shown in FIG. 3B, the brush assembly can include two such radially extending supports 33. Each support 33 is generally connected at one end to the brush mount 31, either using a threaded arrangement, welding or other technique known in the industry, and connected at the other end to the mandrel 20. As illustrated in one exemplary embodiment, the supports 33 are generally rigidly coupled to the brush mount 31 and are slidably positioned through holes 26 in the mandrel 20. The relative geometries of the support 33 and hole 26 facilitate radial movement between the brush assembly 30 and the mandrel 20, while maintaining the brush assembly 30 in an angular position relative to the mandrel 20. Moreover, in exemplary embodiments, fluid leaking between hole 26 and support 33 is provided to assist in chip-removal and cooling operations of the tool 10 and/or workpiece 4. A piston 34 can be attached to the support 33 and positioned within the cylinder 25. The piston 34 is generally dimensioned larger than the hole 26, thereby assisting in preventing the brush assembly 30 from being liberated or from becoming otherwise detached from the mandrel 20. The piston 34 also improves the angular stability of the brush assemblies 30 relative to the mandrel 20.

The radial stroke of the brush assembly 30 between an extended position (see, e.g., FIG. 3B) and a retracted position (see, e.g., FIG. 3A) can vary widely based on the application. For instance, a greater stroke may be required if the surface to be brushed has a diameter greater than the hole through which the tool 10 will be inserted. Exemplary tools 10 can brush cylinders having bore diameters from about 70 mm to about 90 mm. A variety of different mechanisms can be provided as a brush retractor to move the brush assembly 30 from an extended position (see, e.g., FIG. 3B) to a retracted position (see, e.g., FIG. 3A). The brush assembly can be moved to the extended position when the mandrel 20 is rotating. In one embodiment, the centrifugal force induced by the rotation of the mandrel 20 can assist in urging the brush assembly 30 radially outward from a retracted position to an extended position.

One advantage of using centrifugal force to assist in urging the brush assembly 30 to an extended position is that the brushing force against the inner surface 8 of the bore 6 can be easily regulated. Under Newton's Law of Motion, centrifugal force is directly proportioned to angular velocity squared (i.e., $F=m\omega^2R$, where F=force; m=mass; $\omega$=angular velocity; and R=radial distance at center of mass from axis of rotation). Accordingly, the brushing force can be adjustable based on the rotational velocity of the mandrel 20.

As brushes wear down due to use (thus changing the R value), the rotational speed of the tool 10 can be adjusted so that a constant brushing force is exhibited over the life of the brush. In some applications, a relatively high brushing force may be required, while in other applications a relatively low brushing force may be desired. In either case, the brushing load can be adjustable by changing the angular velocity of the mandrel 20.

Figure 3C:
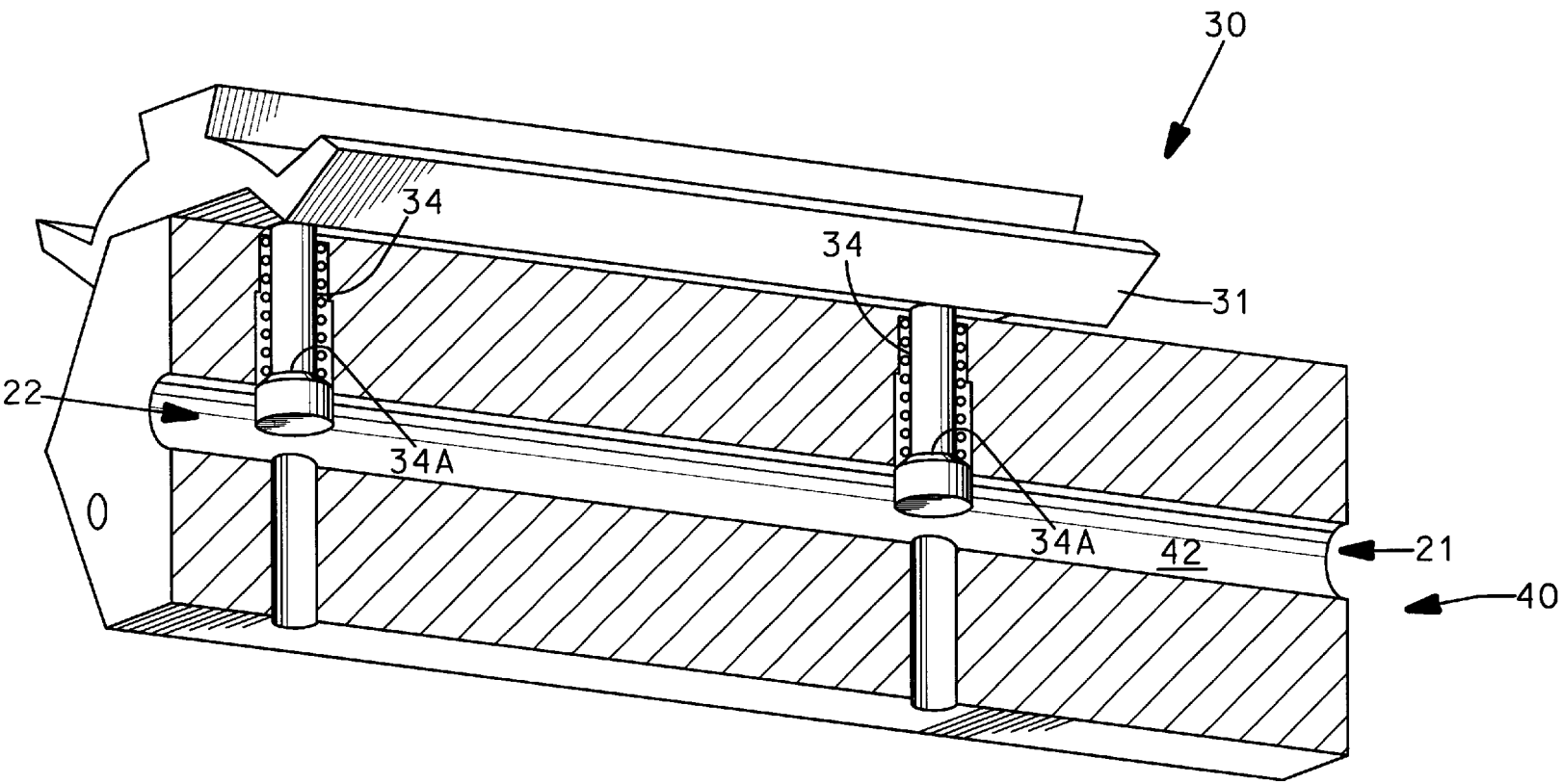
FIG. 3C depicts a cross-sectional oblique view of an alternative brush tool in a retracted position.
Figure 3D:
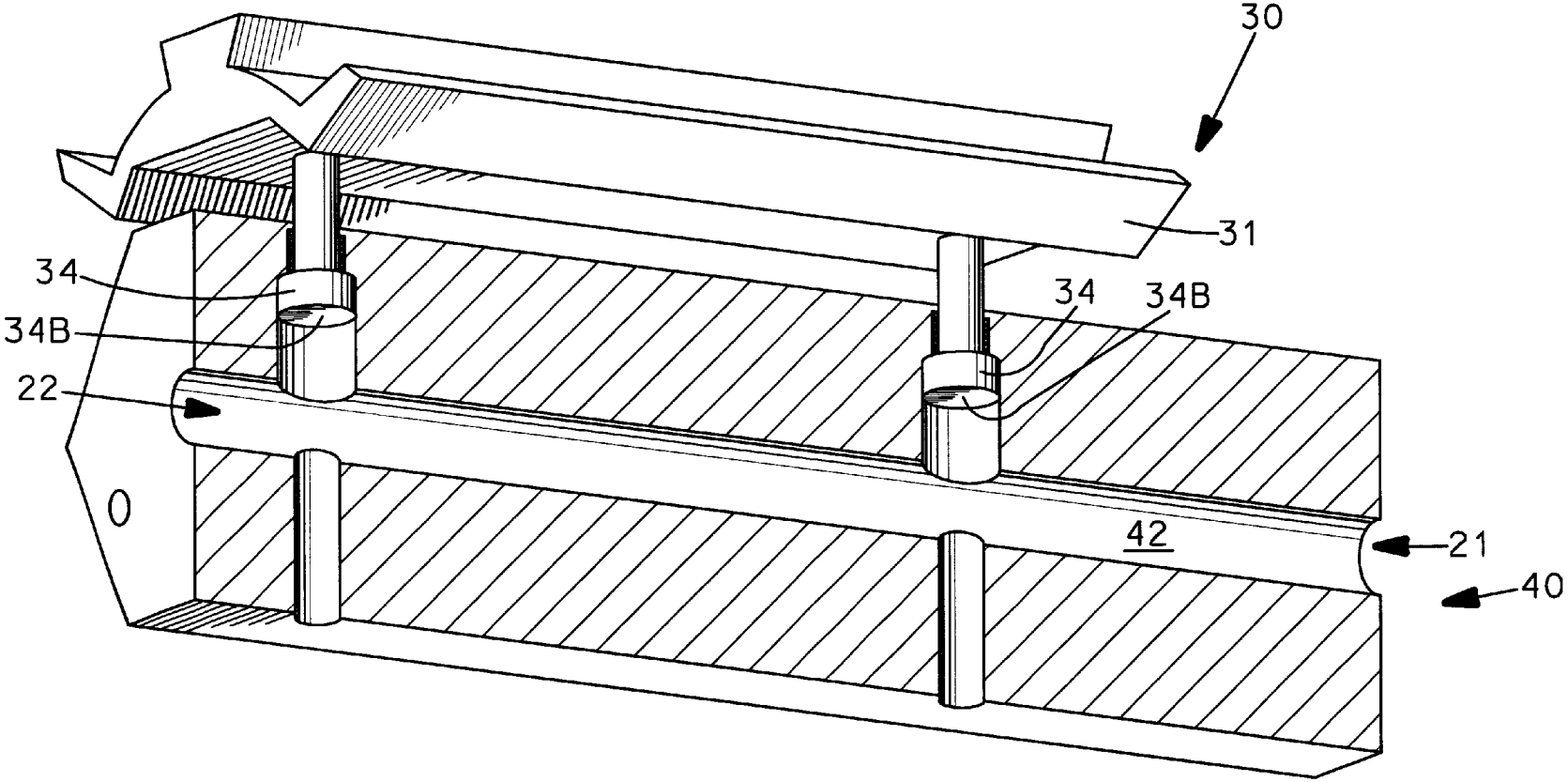
FIG. 3D depicts a cross-sectional oblique view of the brush tool, of FIG. 3C in an extended position.

In further exemplary embodiments, the brush retractor of the tool 10 can include a biasing mechanism, such as a spring, for assisting in urging the brush assembly to a retracted position when the mandrel 20 is not rotating. In exemplary embodiments (e.g., see FIGS. 3A and 3B), the cylinders 25 are in fluid communication with the axial channel 24. As further depicted in FIGS. 3A and 3B, the brush retractor can also include the heads 34 (e.g., inner head surface 34A). For example, the inner head surface 34A can be exposed to the pressurized fluid within the axial channel 24 providing a pressure surface and thereby producing a radially inward load which assists in urging the brush assembly 30 toward a retracted position (see, e.g., FIG. 3A). If the centrifugal force induced by the rotating mandrel 20 is greater than the pressure induced load on the heads 34, the brush assembly 30 will reach in an extended position as illustrated in FIG. 3B. If the mandrel 20 is not rotating, the pressure induced load on the heads 34 will assist in urging the brush assembly 30 toward a retracted position as illustrated in FIG. 3A (assuming fluid pressure is maintained in the axial channel 24). Thus, it is understood that the brush retractor in the embodiments of the present invention described throughout the specification can comprise the head 34 (e.g., inner head surface 34A) and/or the biasing mechanism (e.g., spring 48). Moreover, as illustrated in FIGS. 3C and 3D, the brush retractor could comprise the biasing mechanism while the head may act to extend the brush.

Alternative mechanisms for urging the brush assembly 30 to either an extended position or a retracted position are also contemplated, for instance including a biasing mechanism such as tensile or compressive springs 48 (e.g., coil springs leaf springs, and the like).

Figure 4A:
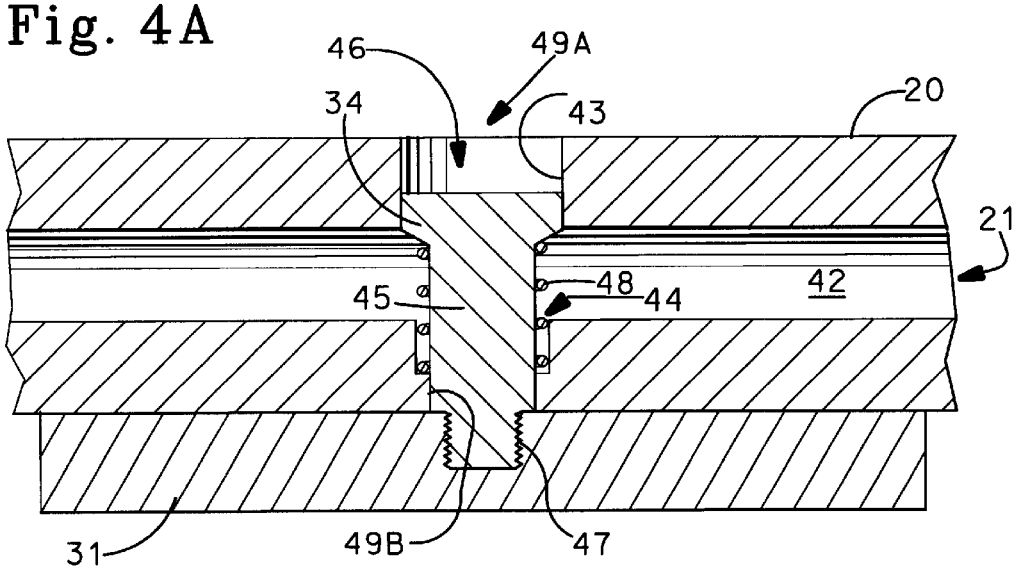
FIG. 4A depicts a cross-sectional view of an alternative embodiment of a brush tool in a retracted position.
Figure 4B:
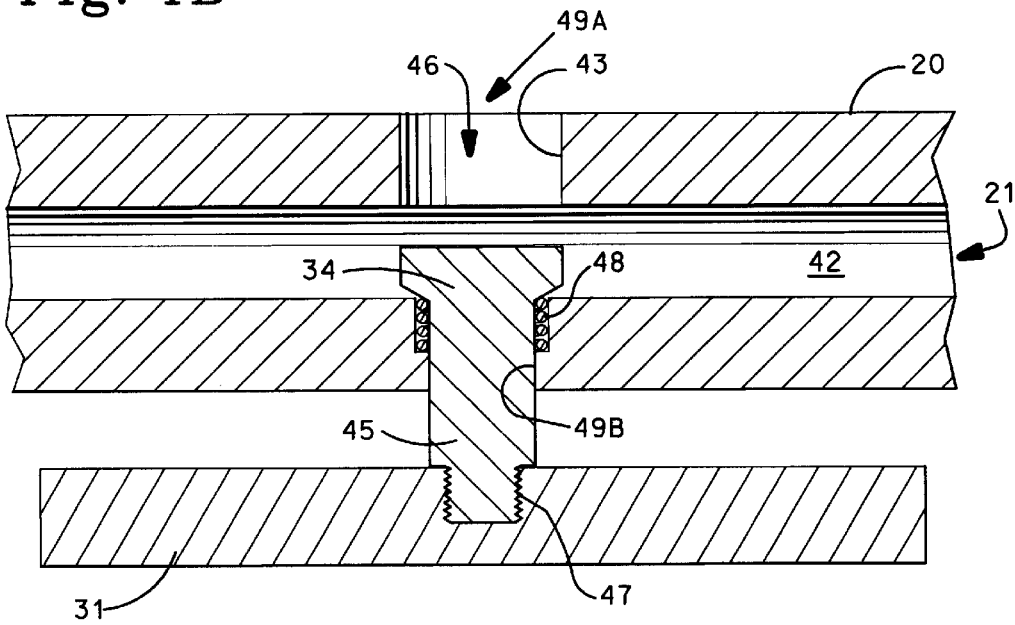
FIG. 4B depicts a cross-sectional view of the tool of FIG. 4A in an extended position.

FIGS. 4A and 4B depict an alternative embodiment of a brushing tool 10. A mandrel 20 has a central fluid channel 42 which receives pressurized fluid through the inlet 21. The mounting support 45 is slidably positioned in the mandrel 20, and can be positioned perpendicular to the central fluid channel 42. The mounting support 45 is dimensioned so that axial fluid flow in the fluid channel 42 is not substantially interrupted. The mounting support 45 includes a brush mount interface 47, such as the threaded member of one end, to which a brush mount 31 can be fastened. At the other end of the mounting support 45 is a head 34 positioned within a valve cylinder 43. A brush retractor, illustrated here as including a compression coil spring 48, extends between the seat 44 and the head 34, and can assist in urging the mounting support 45 and brush mount 31, which fastened to the brush mount interface 47, radially inward relative to the mandrel 20, as exemplified in FIG. 4A. Accordingly, the brush retractor also comprises the head (e.g., the inner head surface) in addition to the biasing mechanism.

The mounting support 45 is radially moveable relative to the mandrel 20 and can exhibit an extended position (see, e.g., FIG. 4B) and a retracted position (see, e.g., FIG. 4A). The rotation of the mandrel 20 about its axis will induce a centrifugal force on a brush mount 31 fastened to the interface 47, thereby urging the brush mount 31 and mounting support 45 radially outward relative to the mandrel 20 toward an extended position as illustrated in FIG. 4B. Any fluid pressure within the fluid channel 42 will act on the head 34 like a piston thereby urging the brush mount 31 and mounting support 45 radially inward relative to the mandrel 20 (e.g., upwardly, as exemplified in FIG. 4A). Accordingly, the brush retractor also comprises the head (e.g., the inner head surface) in addition to the biasing mechanism. If the centrifugal force induced by the rotation of the mandrel 20 is greater than the sum of the spring 48 load and the fluid pressure within the fluid channel 42 acting on the head 34, the brush mount 31 and mounting support 45 will move to an extended position (e.g., FIG. 4B). If the mandrel 20 is not rotating, the pressure induced load on the head 34 and the spring 48 load will assist in urging the brush mount 31 and mounting support 45 to a retracted position as illustrated in FIG. 4A.

In certain exemplary embodiments, a valve may be formed to regulate fluid flow from the tool. For example, as illustrated in FIGS. 4A and 4B, the valve 46 may include the head 34 and valve cylinder 43. When the mounting support 45 moves towards an extended position (see, e.g., FIG. 4B), the head 34 will disengage from the valve cylinder 43 thereby providing fluid communication between inlet 21 and the outlet 49A and 49B. In one exemplary embodiment, outlet 49A may be provided with a plug to assist in restricting fluid flow out through outlet 49A. Pressurized fluid in the channel 42 can exit the tool through outlets 49A and 49B, respectively, and wet the inner surface 8 and the tool 10 with the fluid to cool the workpiece 4 and the tool 10. Accordingly, the valve 46 is generally in a open position when the brush mount 31 is extended (e.g., see FIG. 4B) and in the closed position when the brush mount 31 is retracted (e.g., see FIG. 4A).

Figure 5:
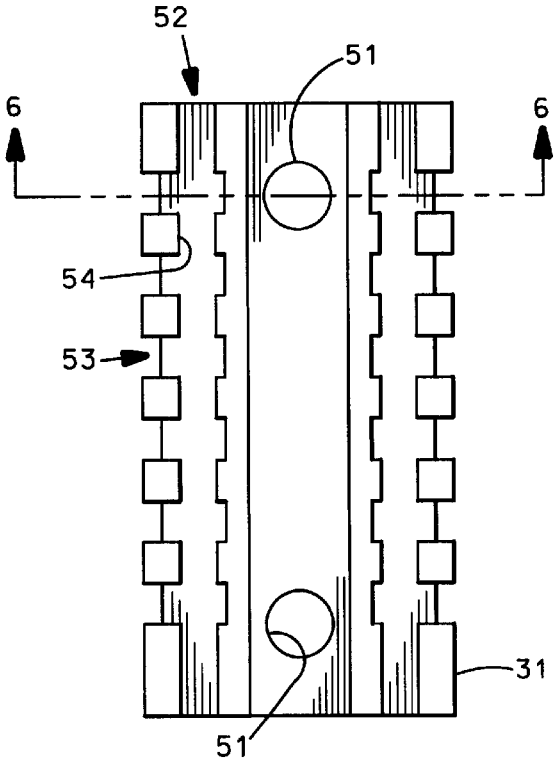
FIG. 5 depicts a brush mount.
Figure 6:
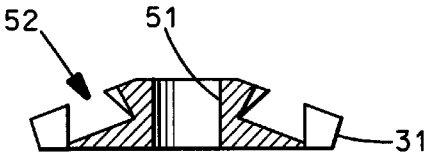
FIG. 6 depicts a cross-sectional view of the brush mount of FIG. 5 taken along lines 6—6.

FIGS. 5 and 6 depict an alternative embodiment of a brush mount 31. Brush mount 31 can include two holes 51, which might be threaded, to which an appropriate mounting support (e.g., 33 or 45) can be fastened. Brush mount 31 can include two locking grooves 52 having intermittent locking teeth 54 and reliefs 53 for selectively and lockably receiving brushes (e.g., 60).

Figure 7:
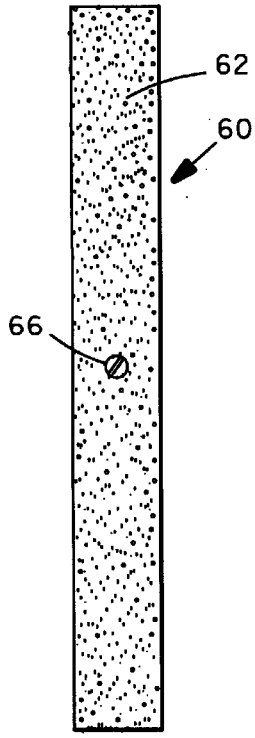
FIG. 7 depicts a top view of a brush of the present invention.
Figure 8:
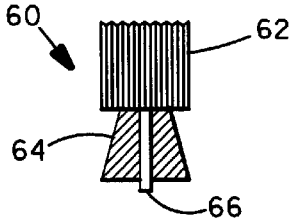
FIG. 8 depicts a cross-sectional view of a brush and brush holder of the present invention.
Figure 9A:
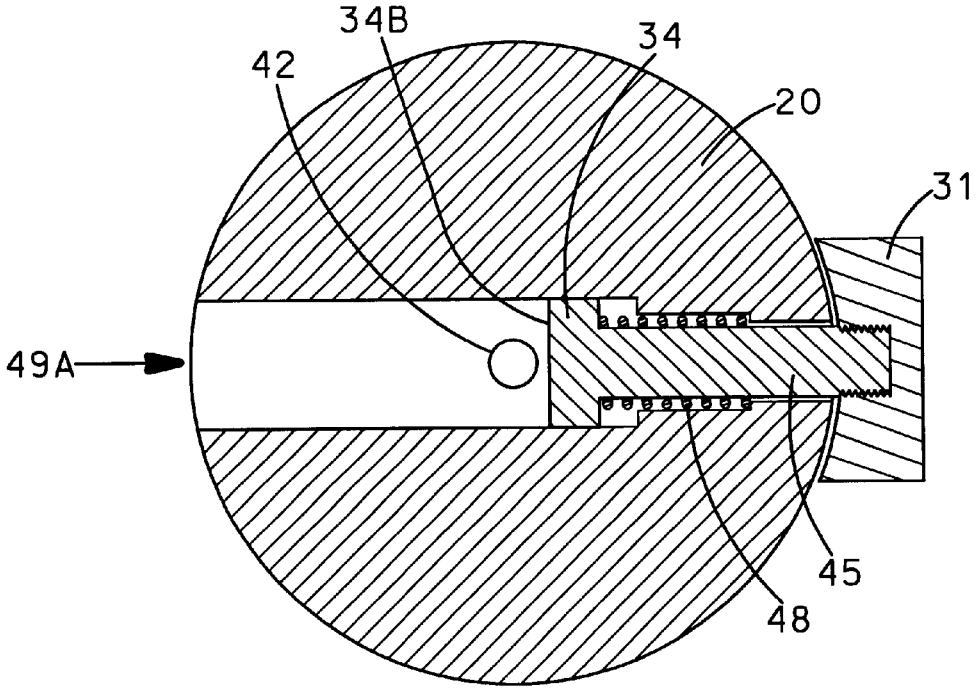
FIG. 9A depicts a cross-sectional view across the brushing tool of another alternative embodiment of the present invention in a retracted position.
Figure 9B:
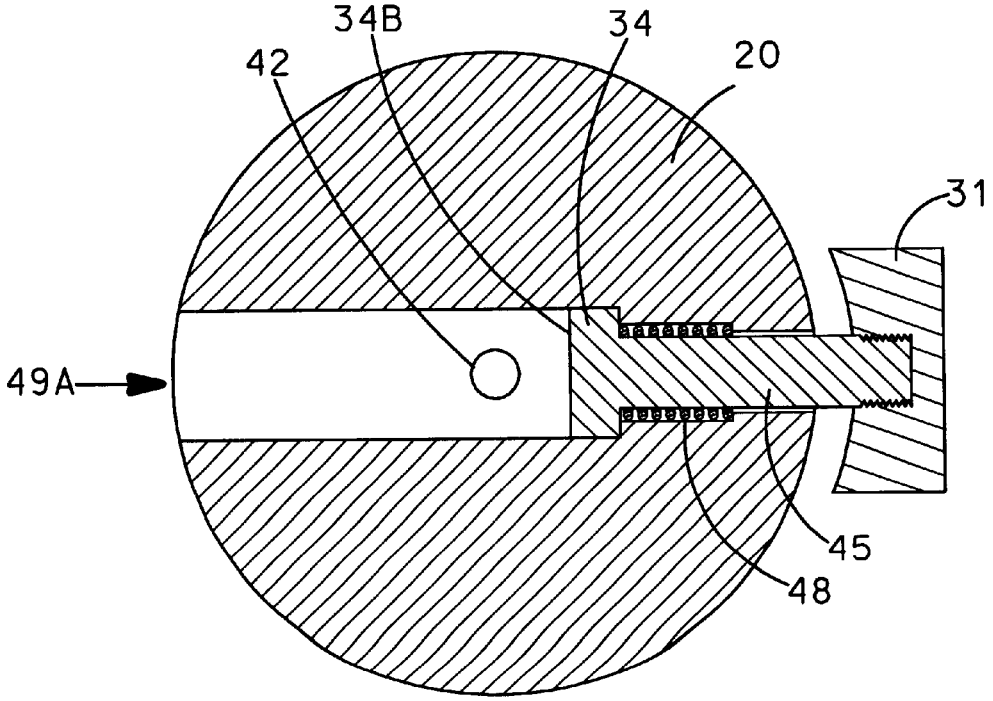
FIG. 9B depicts a cross-sectional view across the tool of FIG. 9A in an extended position.

FIGS. 7 and 8 illustrate one example of a brush 60 adapted to the position within the locking grooves 52. The brush 60 can includes a plurality of bristles 62 mounted on dove tail 64 dimensioned to fit within the groove 52. The dove tail 64 has intermittent teeth and reliefs that correspond to teeth 54 and reliefs 53 in the brush mount 31. Dove tail 64 is inserted into the groove 52 down through the reliefs 53 such that the dove tail 64 is seated within the groove 52. The brush 60 is then shifted axially relative to the brush mount 31 such that the dove tail 64 engages the locking teeth 54, thus preventing the brush 60 from lifting out of the groove 52. An optional set screw 66 may be tightened to further assist in preventing any further axial shifting between the brush 60 and the brush mount 31. It is understood that other exemplary embodiments do not include the set screw arrangement and thereby rely on the locking teeth of the brush mount 31 to prevent axial shifting of the brush 60 relative to the brush mount 31 or lifting of the brush 60 from brush mount 31. The major axis of the brush 62 and the tangent point of the inner surface 8 of the bore 6 can be generally oriented at about 90 degrees.

FIGS. 9A and 9B exemplify another alternative embodiment of the present invention. Mounting support 45 is sized whereby a pressure surface is provided by outer surface 34B of the head 34, irrespective of whether the brush mount is in a retracted position (e.g., FIG. 9A) or an extended position (e.g., FIG. 9B). Fluid pressure in central valve channel 42 assists in urging the brush mount 31 toward an extended position irrespective of whether the tool 10 is being rotated. In use, a brush retractor, such as springs 48, can assist in urging the brush mount 31 from an extended position (e.g., FIG. 9B) to a retracted position (e.g., FIG. 9A).

Figure 10:
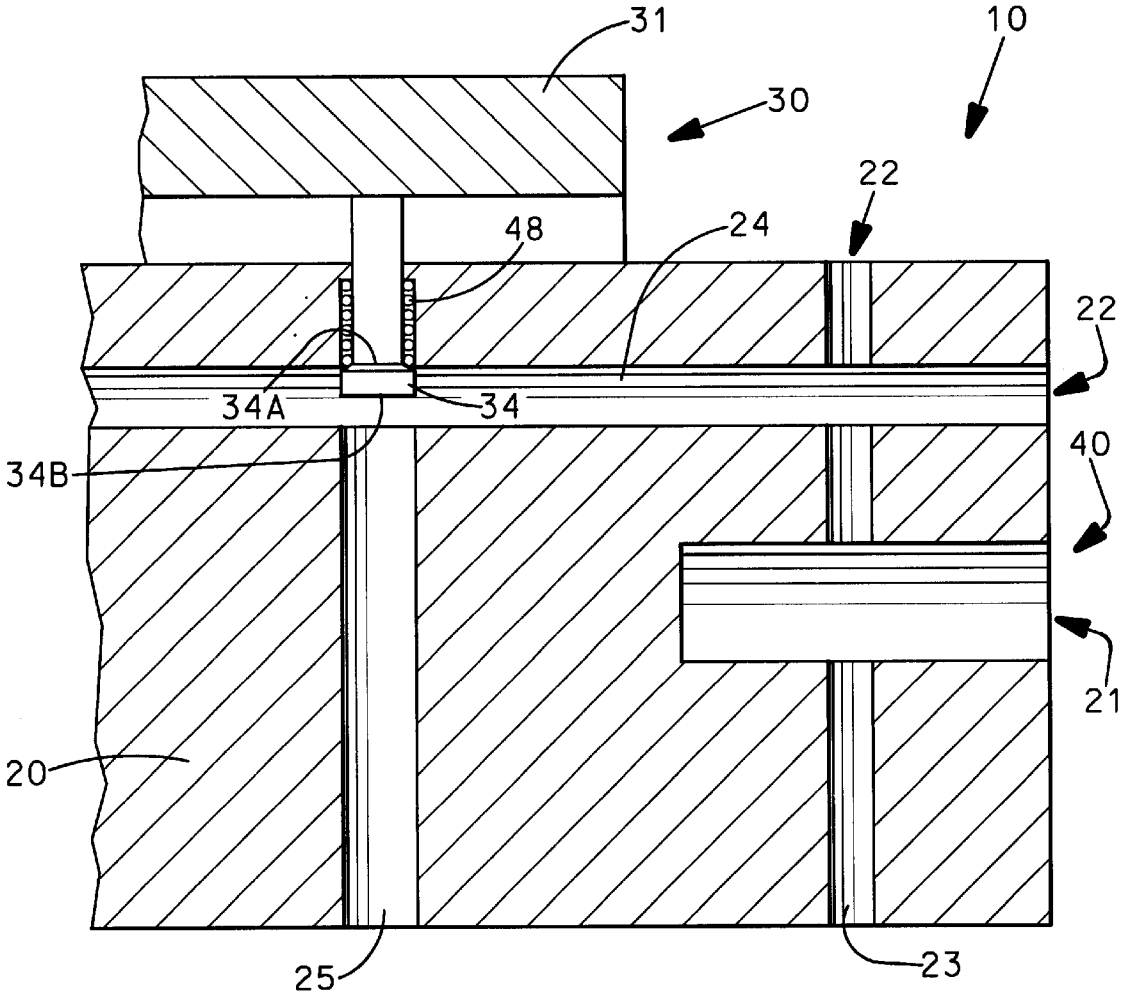
FIG. 10 depicts a cross-sectional view of an alternative embodiment of the tool.

Turning now to FIG. 10, formed within the body of tool 10, is a supply to of flow path 40, which is part of the fluid distribution system extending along the longitudinal length of the tool 10 at predetermined arrangement. Both the tool 10 and the flow path 40 can be oriented so that they share the same center longitudinal access of rotation. A coaxial orientation of tool 10 and flow path 40 may be provided so that the interchange of tools is made in accordance herewith (i.e., securing the tool 10 in place and establishing fluid communication between the spindle passage 16 and the supply tube or flow path) can be accomplished quickly and automatically upon attachment of the tool 10, and to preserve balance in the tool 10 so that eccentricities, which otherwise could cause vibration during use, are held to a minimum. In this regard, off-centered routing of one or more flow paths 40 within a tool could be employed. In such cases, these flow paths may be symmetrically arranged relative to the tool mandrel 20 to preserve balance during high speed tool rotation.

The mandrel 20 and its flow path 40 also include a plurality of outlets 22, which are in fluid communication with fluid source 12. Pressurized fluid can exit through the tool outlets 22 or holes 25 to wet the inner surface 8 and/or the tool 10. Accordingly, the pressurized fluid cools the workpiece as well as the tool 10, and also facilitates the removal of metal shavings or fines in the bore 6. The fluid forcibly discharged from the outlets 22 may further provide substantial cooling between the inner surface 8 and the brush surfaces.

In the embodiment of FIG. 10, the flow path 40 is contained within the mandrel 20, and comprises several radial channels 23 and axial channels 24, thereby establishing fluid distribution system within the mandrel 20. Pressurized fluid can enter the mandrel 20 and its flow path 40 through the inlet 21, and through the radial channels 23 to be axially distributed along the axial channels 24. Fluid can exit the mandrel 20 via the outlets 22 or cylinder 25. It is also contemplated that one or more outlets 22 may be plugged to restrict and/or control, meter, or regulate fluid flow out of the mandrel 20 therethrough. Such plugs might take the form of a valve or a valve stop. The brush assemblies 30 are configured with a brush retractor comprising the head 34 (e.g., a pressure surface is provided by the outer surface 34B of the head 34), irrespective whether the brush mount is in an extended position, as shown in FIG. 10 or a retracted position. Fluid pressure in axial channels 24 can assist in urging the brush mount 31 toward an extended position irrespective of whether the tool is being rotated or not. As illustrated, the brush retractor could also include a biasing mechanism (e.g., springs 48) to bias the brush mount from an extended position (e.g., see FIG. 10) to a retracted position. It is understood that the brush retractor in the embodiments of the present invention can comprise the head 34 (e.g., outer head surface 34B) and/or the biasing mechanism (e.g., spring 48).

The foregoing description of the preferred embodiment of the invention has been presented for purposes of illustration and description. It is not intended to be exhaustive nor to limit the invention to the precise form disclosed. Many alternatives, modifications, and variations will be apparent to those skilled in the art in light of the above teaching. For instance, the present invention can be applied to brush any surface, whether it be a hole or otherwise. Accordingly, this invention is intended to embrace all alternatives, modifications, and variations that fall within the spirit and broad scope of the amended claims.

We claim:

1. A tool for brushing an inner surface of a hole, the tool comprising:

a) a rotatable shaft provided with an inlet for fluid communication with a source of pressurized fluid, at least one outlet positioned so as to wet an inner surface of a hole, and a flow path extending between the inlet and the outlet;

b) at least one brush mount being radially moveable relative to the shaft to an extended position anal a retracted position, wherein the brush mount is adapted to move to the extended position when the shaft is rotating; and c) a brush retractor adapted to urge the brush mount to the retracted position.

2. The tool of claim 1, wherein the brush retractor comprises a spring.

3. The tool of claim 1, wherein the brush retractor comprises a pressure surface.

4. The tool of claim 3, further comprising a piston connected to the at least one brush mount, wherein the piston includes the pressure surface.

5. The tool of claim 4, further comprising at least one support slidably received by the shaft and being attached at one end to a corresponding brush mount and attached at the other end to a corresponding piston thereby connecting the corresponding piston to the corresponding brush mount and permitting radial movement of the at least one brush mount relative to the shaft.

6. The tool of claim 3, wherein the pressure surface can be arranged such that any pressurized fluid in the flow path acts on the pressure surface to induce a radially inward load to urge the at least one brush mount to the retracted position.

7. The tool of claim 1, further comprising a pressure surface that can be arranged such that any pressurized fluid in the flow path acts on the pressure surface to induce a radially outward load to urge the at least one brush mount to the extended position.

8. The tool of claim 1, wherein the brush retractor comprises a spring and a pressure surface.

9. The tool of claim 1, further comprising at least one valve positioned in the flow path for controlling fluid flow through the outlet, wherein the at least one valve is capable of being oriented in an opened position when the brush is in the extended position and a closed position when the brush is in the retracted position.

10. The tool of claim 1, wherein a predetermined brushing load can be maintained on an inner surface of a hole by controlling the rotational velocity of the shaft.

11. A metal working machine, comprising the tool of claim 1.

12. The tool of claim 1, further comprising at least one brush mounted to the at least one brush mount.

13. The tool of claim 12, wherein the at least one brush is removably mounted to the at least one brush mount.

14. The tool of claim 13, wherein the at least one brush mount comprises at least one locking groove adapted to removably mount the at least one brush to the at least one brush mount.

15. The tool of claim 1, wherein the rotatable shaft defines the inlet for fluid communication with a source of pressurized fluid.

16. A tool for brushing an inner surface of a hole, the tool comprising:

a) a mandrel capable of being rotated about an axis;

b) a fluid channel in the mandrel having an inlet for receiving pressurized fluid and at least one outlet for wetting an inner surface of a hole; and c) a brush assembly attached to the mandrel comprising at least one brush, the brush assembly being radially moveable relative to the mandrel to an extended position and a retracted position, wherein the brush assembly is adapted to move to the extended position at least in part due to an outward radial force generated by the rotation of the mandrel when the mandrel is rotating.

17. The tool of claim 16, further comprising a valve positioned in the fluid channel for controlling the fluid flow through the outlet, the valve being opened when the brush assembly is in the extended position and closed when the brush assembly is in the retracted position.

18. The tool of claim 17, wherein at least a portion of the valve is linked to the brush assembly.

19. The tool of claim 16, wherein the brush assembly further comprises at least one brush mount and one or more supports attached at one end to the at least one brush mount and slidably attached to the mandrel at the other end.

20. The tool of claim 16, further comprising a brush retractor adapted to urge the brush assembly to the retracted position.

21. The tool of claim 20, wherein the mandrel is capable of rotating such that the brush assembly is influenced by an outward radial force that is greater than a load induced on the brush assembly by the brush retractor.

22. The tool of claim 16, wherein a predetermined brushing load can be maintained on an inner surface of a hole by controlling the rotational velocity of the mandrel.

23. A tool for brushing an inner surface of a hole, the tool comprising:

a) a mandrel capable of being rotated about an axis;

b) a fluid channel in the mandrel having an inlet for receiving pressurized fluid and an outlet for wetting an inner surface of a hole;

c) a brush assembly comprising at least one brush attached to a brush mount and one or more supports attached at one end to the brush mount and slidably attached to the mandrel at the other end, the brush assembly being radially moveable relative to the mandrel to an extended position and a retracted position, wherein the brush assembly is adapted to move to the extended position at least in part due to an outward radial force generated by the rotation of the mandrel when the mandrel is rotating; and d) a brush retractor inducing a radially inward load on the brush assembly thereby biasing the brush assembly toward the retracted position, wherein the brush assembly may be urged to the extended position by rotating the mandrel such that the brush assembly is influenced by an outer radial force that is greater than the inward load induced by the brush retractor.

24. The tool of claim 23, further comprising a valve, at least a portion of the valve being linked to the brush assembly, wherein the valve is for controlling the flow of fluid through the outlet, the valve being opened when the brush assembly is in the extended position and closed when the brush assembly is in the retracted position.

* * * * *